US008328054B2

(12) United States Patent
Oh

(10) Patent No.: US 8,328,054 B2
(45) Date of Patent: Dec. 11, 2012

(54) REFRIGERATOR RELATED TECHNOLOGY

(75) Inventor: Seung-Hwan Oh, Seoul (KR)

(73) Assignee: LG Electronics Inc., Seoul (KR)

( * ) Notice: Subject to any disclaimer, the term of this patent is extended or adjusted under 35 U.S.C. 154(b) by 502 days.

(21) Appl. No.: 12/625,932

(22) Filed: Nov. 25, 2009

(65) Prior Publication Data

US 2010/0132835 A1 Jun. 3, 2010

(30) Foreign Application Priority Data

Nov. 28, 2008 (KR) ..... 10-2008-0120090

(51) Int. Cl.
*B65B 1/04* (2006.01)

(52) U.S. Cl. ..... 222/504; 222/146.6

(58) Field of Classification Search ..... 222/504, 222/146.1, 146.6; 141/311 R
See application file for complete search history.

(56) References Cited

U.S. PATENT DOCUMENTS

| | | | | |
|---|---|---|---|---|
| 3,942,334 | A * | 3/1976 | Pink | 62/266 |
| 4,090,641 | A * | 5/1978 | Lindenschmidt | 222/504 |
| 4,898,308 | A * | 2/1990 | Rudick | 222/325 |
| 4,921,149 | A * | 5/1990 | Miller et al. | 222/639 |
| 5,526,854 | A * | 6/1996 | Unger | 141/351 |
| 6,135,173 | A * | 10/2000 | Lee et al. | 141/361 |
| 6,188,029 | B1 * | 2/2001 | Miyamoto et al. | 177/105 |
| 6,533,003 | B1 * | 3/2003 | Jacobus et al. | 141/360 |
| 7,316,121 | B2 * | 1/2008 | Lee et al. | 62/344 |
| 8,042,708 | B2 * | 10/2011 | Jeong et al. | 222/146.6 |
| 2006/0201193 | A1 * | 9/2006 | Bowen et al. | 62/344 |
| 2010/0219205 | A1 * | 9/2010 | Jennison | 222/167 |

FOREIGN PATENT DOCUMENTS

| | | | |
|---|---|---|---|
| KR | 1999034649 | A | 5/1999 |
| KR | 2006000196 | A | 1/2006 |
| KR | 2007115004 | A | 12/2007 |
| KR | 2008003675 | A | 1/2008 |

OTHER PUBLICATIONS

International Search Report & Written Opinion issued in Application No. PCT/KR2009/007009, mailed Jul. 19, 2010, 10 pages.

* cited by examiner

*Primary Examiner* — Kevin P Shaver
*Assistant Examiner* — Donnell Long
(74) *Attorney, Agent, or Firm* — Fish & Richardson P.C.

(57) ABSTRACT

Disclosed is a refrigerator includes a main body having a cooling chamber. The refrigerator also includes a dispenser having an accommodation portion positioned at a front side of the refrigerator and configured to provide ice through the accommodation portion without opening a door of the refrigerator. The refrigerator further includes a chute having an outlet, coupled to the dispenser, and configured to transfer ice stored in an ice container to the dispenser. In addition, the refrigerator includes an opening and closing member positioned at the outlet of the chute and configured to open or close the outlet of the chute in response to a driving signal, wherein the opening and closing member and the outlet of the chute have a circular shape.

11 Claims, 6 Drawing Sheets

REFRIGERATOR RELATED TECHNOLOGY

CROSS-REFERENCE TO RELATED APPLICATIONS

The present application claims the benefit of priority to Korean Application No. 10-2008-0120090, filed on Nov. 28, 2008, the contents of which is hereby expressly incorporated by reference in its entirety.

FIELD

The present disclosure relates to refrigerator technology.

BACKGROUND

A refrigerator is a device in which cool air is generated by a refrigerating cycle to keep various types of foods in a fresh state for a long period of time.

The refrigerator includes a main body having a storage chamber for keeping foods, and a door coupled to one side of the main body by a hinge for opening and closing the storage chamber. The main body has a refrigerating cycle for providing cool air into the cooling chamber. The refrigerating cycle typically includes a compressor for compressing a refrigerant, a condenser for condensing a refrigerant by emitting heat, an expansion apparatus for expanding the refrigerant, and an evaporator for evaporating the refrigerant by making the refrigerant absorb peripheral latent heat.

The door of the refrigerator may have a dispenser for allowing a user to take water or ice out of the refrigerator without opening the door. In general, the dispenser includes an accommodation portion recessed inwardly from an outer surface of the door such that a front surface can be open. A chute for connecting between inside and outside of the door is positioned at an upper region of the accommodation portion. An ice maker and an ice bank for storing ice cubes may be positioned at an upper side of the chute. An opening and closing member for opening and closing an outlet of the chute and a driving unit for driving the opening and closing member may be positioned in the accommodation portion. A shielding member for shielding the opening and closing member and the driving unit so as to be invisible may be positioned at a front surface of the accommodation portion.

SUMMARY

In one aspect, a refrigerator includes a main body having a cooling chamber and a dispenser having an accommodation portion positioned at a front side of the refrigerator and configured to provide ice through the accommodation portion without opening a door of the refrigerator. The refrigerator also includes a chute having an outlet, coupled to the dispenser, and configured to transfer ice stored in an ice container to the dispenser. The refrigerator further includes an opening and closing member positioned at the outlet of the chute and configured to open or close the outlet of the chute and a motor configured to generate a driving force to move the opening and closing member. In addition, the refrigerator includes a guide protrusion defined at a shaft of the opening and closing member and a driving unit configured to be driven by the motor and configured to apply force to the guide protrusion to open and close the opening and closing member.

Implementations may include one or more of the following features. For example, the driving unit may include a driving gear rotated by the motor in a direction of the opening and closing member being open or closed and a driving protrusion that extends from a side surface of the driving gear to be parallel to the shaft of the opening and closing member, and that is configured to transfer a driving force to the guide protrusion. The driving unit further may include a stopper configured to restrict movement of the driving protrusion. The stopper may be a movement restricting groove positioned at the motor and the driving gear may be driven by a worm gear disposed at a rotary shaft of the motor.

In some examples, the driving unit may include a driving gear rotated by the motor in a direction of the opening and closing member being open or closed and a connection link having a central portion rotatably fixed so as to receive a driving force of the driving gear at one end thereof and transfer the driving force to the guide protrusion at another end thereof. In these examples, the connection link may include a rotation center portion rotatably disposed to be parallel to a movement surface of the driving gear, a first arm portion coupled to the driving protrusion, and a second arm portion coming in contact with the guide protrusion to transfer a driving force. The driving protrusion may extend from a side surface of the driving gear to be parallel to a rotary shaft of the opening and closing member.

In some implementations, the guide protrusion may slide to come in contact with a connection protrusion upon the driving gear being driven and the connection protrusion may extend from the second arm portion to be parallel to the rotary shaft of the opening and closing member. In these implementations, the connection protrusion may be coupled to a guide slot to receive a driving force. The guide slot may be disposed at the guide protrusion in a lengthwise direction thereof. The opening and closing member may be configured to be downwardly inclined about 40~42° from a horizontal surface when the chute is closed.

In another aspect, a refrigerator includes a main body having a cooling chamber and a dispenser having an accommodation portion positioned at a front side of the refrigerator and configured to provide ice through the accommodation portion without opening a door of the refrigerator. The refrigerator also includes a chute having an outlet, coupled to the dispenser, and configured to transfer ice stored in an ice container to the dispenser. A plane of the outlet of the chute is configured to be perpendicular to a central line of the chute. The refrigerator further includes an opening and closing member positioned at the outlet of the chute and configured to open or close the outlet of the chute.

Implementations may include one or more of the following features. For example, the opening and closing member may be configured to be downwardly inclined about 40~42° from a horizontal surface when the chute is closed. The opening and closing member may be opened in response to detecting an insertion of a container to the dispenser.

In some implementations, the dispenser may include a shield portion configured to visually shield at least one component in the dispenser. In these implementations, at least one control button may be positioned on the shield portion.

In yet another aspect, a refrigerator includes a main body having a cooling chamber and a dispenser having an accommodation portion positioned at a front side of the refrigerator and configured to provide ice through the accommodation portion without opening a door of the refrigerator. The refrigerator also includes a chute having an outlet, coupled to the dispenser, and configured to transfer ice stored in an ice container to the dispenser. The refrigerator further includes an opening and closing member positioned at the outlet of the chute and configured to open or close the outlet of the chute, a driving motor configured to generate a driving force to open or close the opening and closing member, and a driving unit configured to move the opening and closing member in response to the driving force generated by to the driving motor. The driving unit is configured to enable adjustment of a position of the opening and closing member without moving the driving motor.

Implementations may include one or more of the following features. For example, the driving motor may be a direct current (DC) motor. The opening and closing member and the outlet of the chute may have a circular shape.

In some implementations, the driving unit may include a driving gear configured to be rotated by the motor in a direction of the opening and closing member being open or closed. In these implementations, the driving unit further may include a driving protrusion that extends from a side surface of the driving gear and a connection link configured to transfer the driving force provided by the driving motor to the opening and closing member.

DETAILED DESCRIPTION

Figure 1:
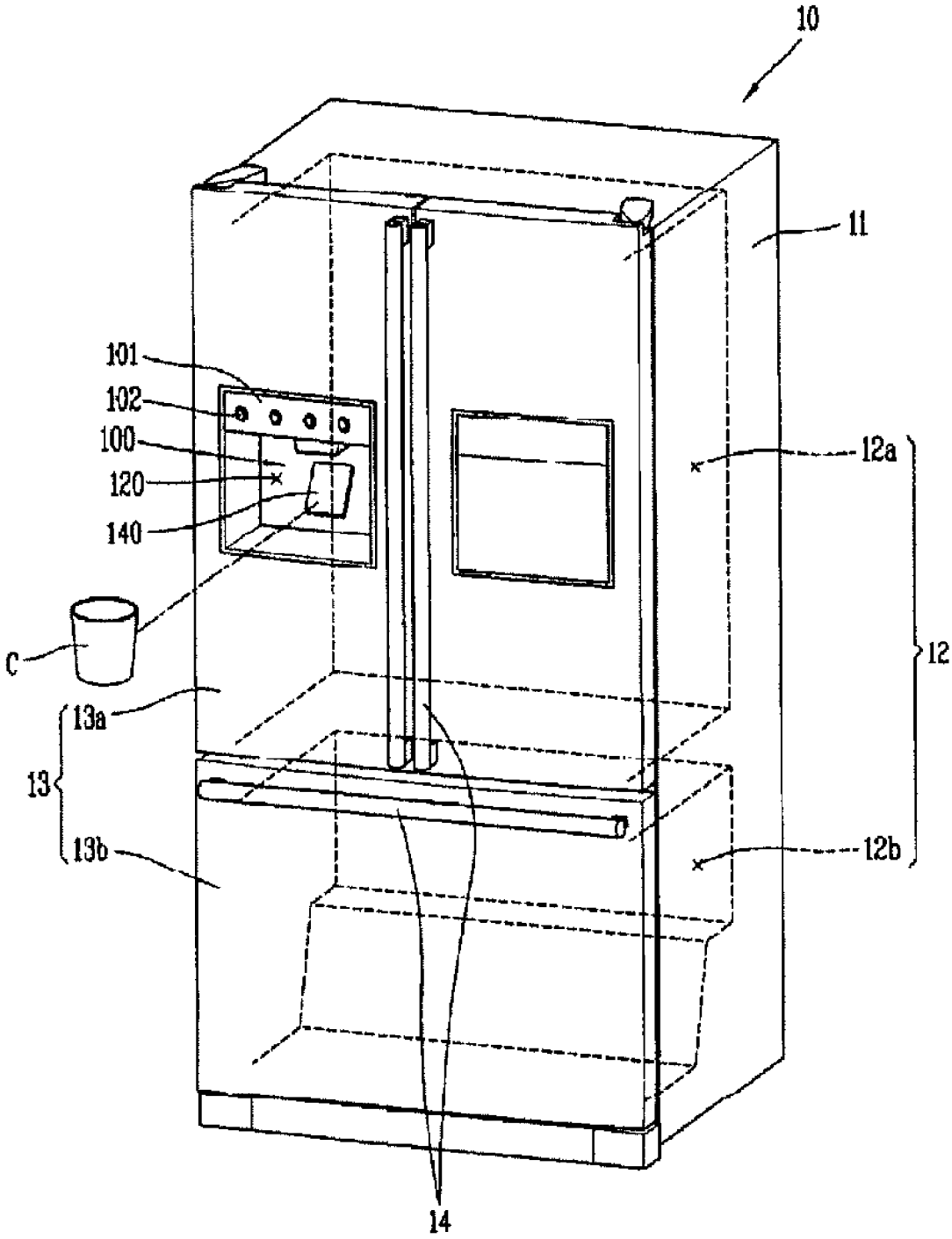
FIG. 1 is a perspective view showing an outer appearance of a refrigerator having a dispenser.

Referring to FIG. 1, a refrigerator 10 may include a main body 11 having a cooling chamber 12, a door 13 for opening and closing the cooling chamber 12 and a dispenser 100 for providing ice. Although not shown in FIG. 1, the main body 11 may have a refrigerating cycle for cooling the cooling chamber 12. The refrigerating cycle may be implemented as a vapor-compression refrigerating cycle, including a compressor, a condenser, an expansion apparatus and an evaporator.

The main body 11 is defined as a shape of a rectangular box, and the cooling chamber 12 has an open front surface and is positioned in the main body 11.

An insulator is inserted in a wall (frame) defining the cooling chamber 12, for example, in a space defined by a wall surface of the cooling chamber 12 and an outer surface of the main body 11, so as to insulate the cooling chamber 12 from the exterior of the main body 11.

The insulator may typically be defined by filling a liquid foaming material and solidifying the filled foaming material.

The cooling chamber 12 may include a refrigerating chamber, a freezing chamber, a vegetable chamber and the like which are segmented into a plurality of spaces based on having different storage temperatures and storage environments.

Air which is cooled after flowing through the evaporator is supplied into the cooling chamber 12 via a cool air supply passage disposed in the main body 11, so as to cool the inside of the cooling chamber 12.

As shown FIG. 1, the main body may be implemented as a bottom freezer type refrigerator. The bottom freezer type refrigerator has a refrigerating chamber 12*a* that is positioned at an upper side of a freezing chamber 12*b*. As another example, the main body 11 may be implemented as a top freezer configured that the refrigerating chamber 12*a* is positioned at a lower side of a freezing chamber 12*b*. In addition, the main body 11 may be implemented as a side by side freezer where the refrigerating chamber 12*a* and the freezing chamber 12*b* are positioned in series. The door 13 may be coupled to the main body 11 by a hinge and configured to rotate with respect to the main body. Alternatively, the door 13 may be coupled to the main body 11 and configured to be slidable from the main body 11 in a back-and-forth direction. The door 13 may include a refrigerating chamber door 13*a* for opening and closing the refrigerating chamber 12*a* and a freezing chamber door 13*b* for opening and closing the freezing chamber 12*b*. In this implementation, the refrigerating chamber door 13*a* is rotatable with respect to the main body 11 and the freezing chamber door 13*b* is slidable from the main body 11.

The door 13 may have one or more door handles 14 for facilitating the opening and closing thereof.

Similar to the wall of the cooling chamber 12, the insulator is also inserted in an inside of the door 13 so as to insulate the cooling chamber 12 from the exterior.

Regarding the number of doors 13, FIG. 1 shows that the refrigerating chamber doors 13*a* are two and the freezing chamber door 13*b* is one. However, depending on a configuration of the cooling chamber 12, more than two doors for the refrigerating chamber 12*a* and more than one freezing chamber 12*b* may be possible.

The door 13 may have a dispenser 100 for allowing a user to dispense ice cubes stored in the cooling chamber 12. Here, description will be given of an example that the dispenser 100 is positioned at the refrigerating chamber door 13*a*, as shown in FIG. 1.

Figure 2:
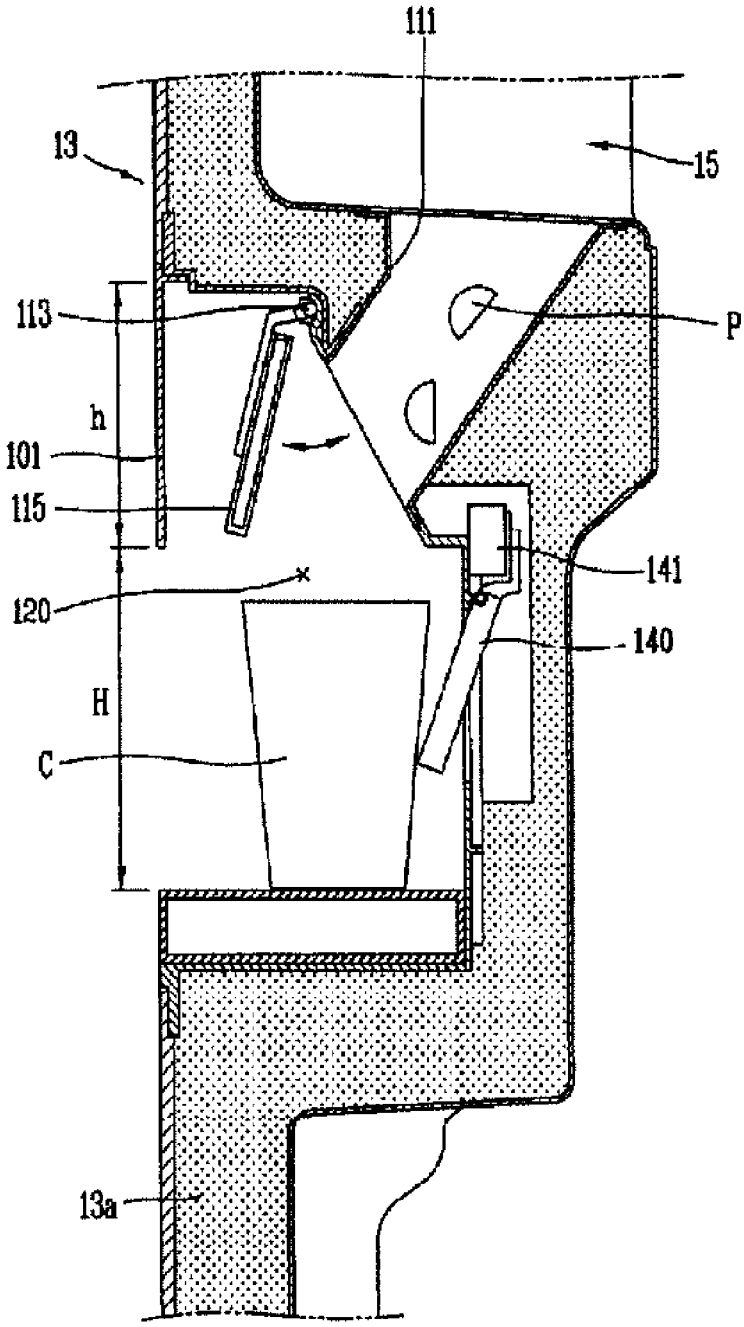
FIG. 2 is a longitudinal sectional view of the dispenser of FIG. 1.

Referring to FIG. 2, the dispenser 100 may include an accommodation portion 120 recessed from a front surface of the door in a thickness direction and having a front surface open, a shielding portion 101 positioned at an upper side of the accommodation portion 120 for shielding components of the dispenser 100 located at the rear side thereof to be more difficult to perceive (e.g., hidden or invisible) from the exterior, and a lever 140 positioned at a rear surface of the accommodation portion 120 and pressed by a container C for receiving ice cubes discharged via the dispenser 100 to generate a driving signal of the dispenser 100.

The lever 140 may be configured to be elastically supported in an opposite direction to a direction of being pressed by the container C. A switch 141 is contacted by the lever 140. For example, based on a rotation of the lever 140, the switch 141 is pressed. The switch 141 may be positioned at the rear side of the lever 140. Then, the dispenser may start an operation related to discharging ice.

The shielding portion 101 may have control buttons 102 for controlling the operation of the dispenser 100 or controlling the operation of the refrigerator 10, as shown FIG. 1. Alternatively, the control buttons 102 may be is positioned at a right side or a left side of the accommodation portion 120.

As shown in FIG. 2, in the dispenser 100 of the refrigerator 10, one side of the dispenser 100 may have a chute 111 to connect between an ice maker 15 positioned inside the door 13 and the accommodation portion 120. Ice cubes (P) dropped from the ice maker 15 are transferred to the accommodation portion 120 through the chute 111. The ice maker 15 may include an automatic ice maker and/or an ice bank.

An opening and closing member 115 for opening and closing an outlet of the chute 111 may be positioned at an end portion (e.g., a discharge side) of the chute 111.

The opening and closing member 115 may be coupled to a rotary shaft 113 positioned at an upper side of the accommodation portion 120 in a horizontal direction. The opening and closing member 115 thus rotates in a thickness direction of the door 13 so as to open and close the end portion of the chute 111. Here, the opening and closing member 115 may be pressed by a spring in a direction of blocking (closing) the end portion of the chute 111.

The rotary shaft 113 is pressed and rotated by a driving unit 116. The driving unit 116 will be described later in more detail with reference to FIG. 3.

The shielding portion 101 may be positioned at an upper region of the accommodation portion 120 such that the opening and closing member 115, the chute 111 and the driving unit 116 can be visually shielded from the exterior. The height h of the shielding portion 101 may be determined based on a radius of rotation of the opening and closing member 115, the lowermost position of the chute 111 and an installation position of the driving unit 116

Figure 3:
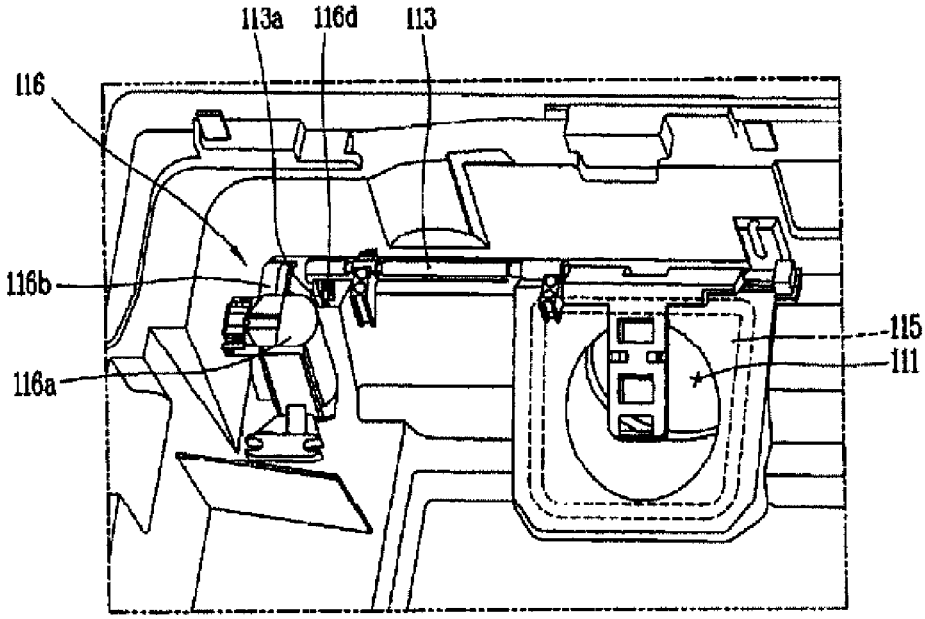
FIG. 3 is a partially enlarged view showing primary components in the dispenser of FIG. 1.
Figure 4:
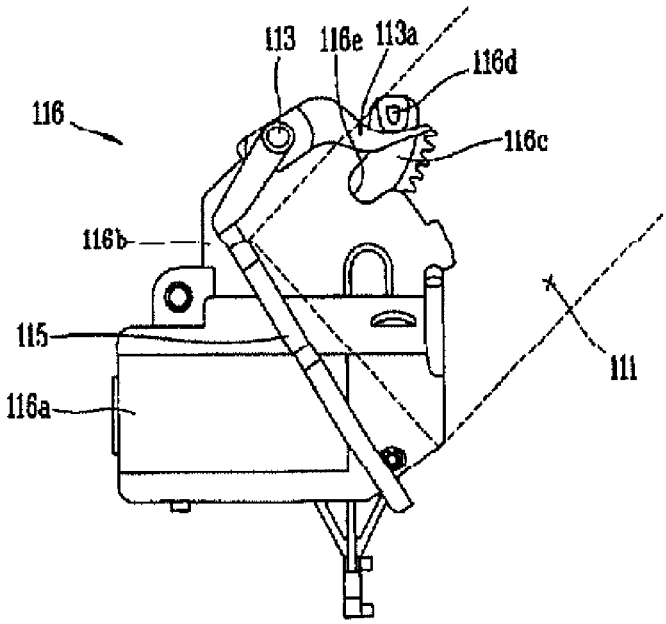
FIG. 4 is a side view showing states of a motor and an opening and closing member in a closed state of a chute of FIG. 3.
Figure 5:
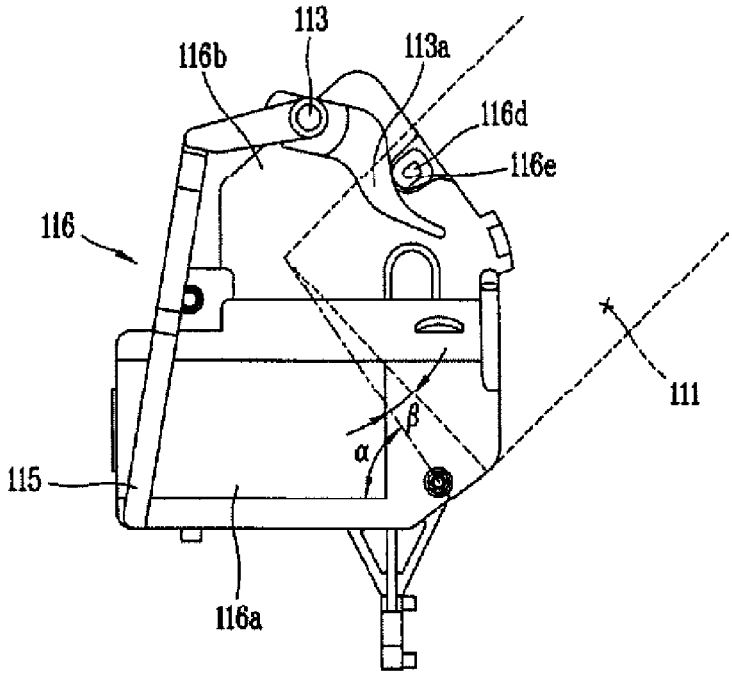
FIG. 5 is a side view showing states of the motor and the opening and closing member in an open state of the chute of FIG. 3.
Figure 6:
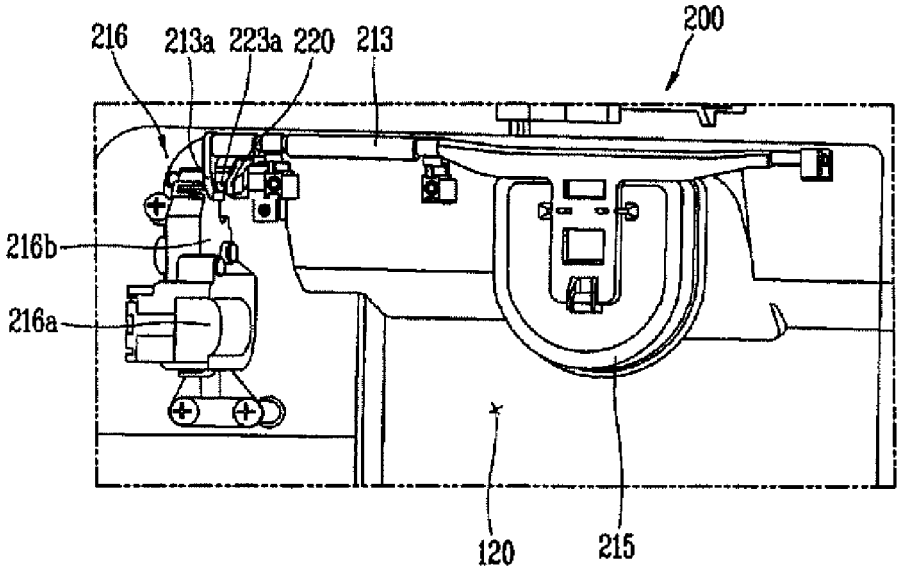
FIG. 6 is a partially enlarged view showing primary components of a dispenser.
Figure 7:
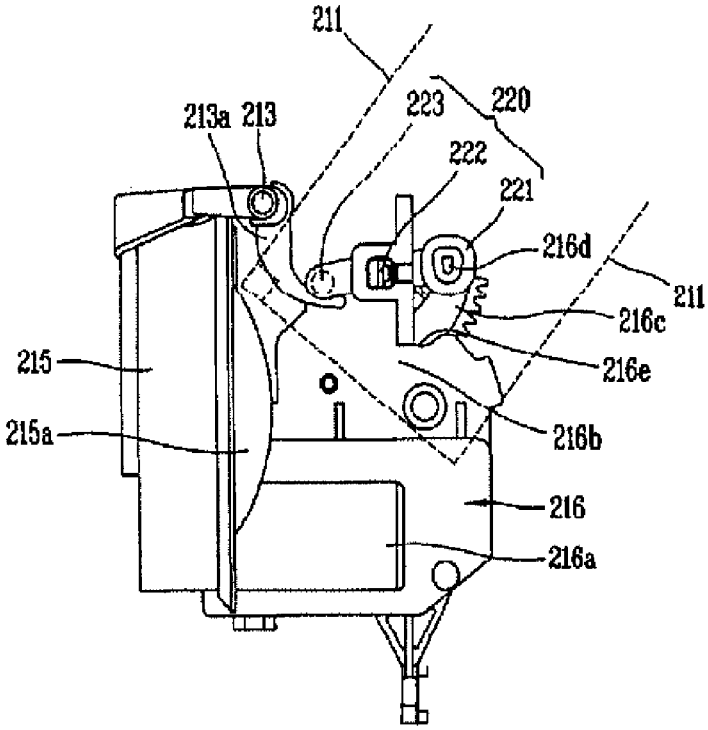
FIG. 7 is a side view showing states of a motor and an opening and closing member in a closed state of a chute of FIG. 6.
Figure 8:
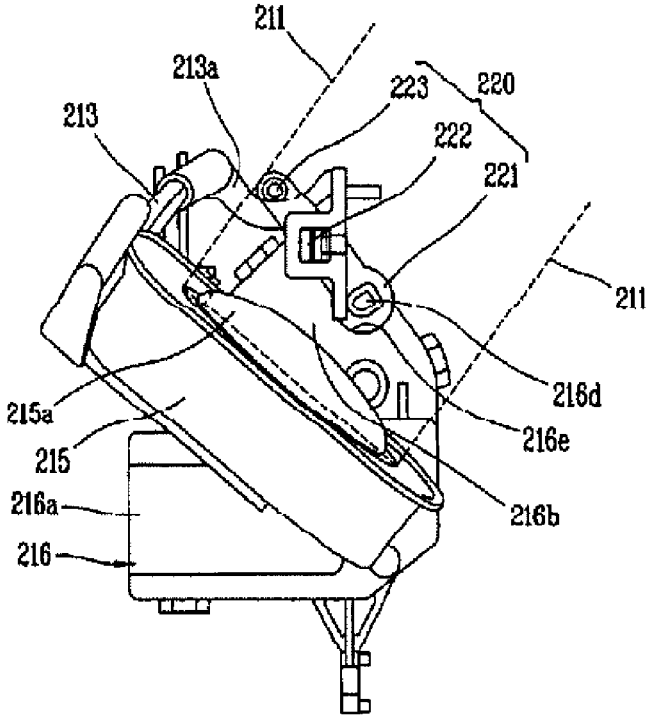
FIG. 8 is a side view showing states of the motor and the opening and closing member in an open state of the chute of FIG. 6.

In addition, a height H of the accommodation portion 120 which is not shielded by the shielding portion 101 may have a maximum height high enough to accommodate the container C for receiving ice or the like. As the height H becomes higher, a larger container C can be inserted into the accommodation portion 120. As shown in FIGS. 3 to 5, the chute 111 is positioned at the upper portion of the accommodation portion 120 and configured to transfer the ice cubes in the ice maker 15 to the accommodation portion 120. The opening and closing member 115 for opening and closing the chute 111 is coupled to the rotary shaft 113. The rotary shaft 113 is configured to rotate the opening and closing member 115. The driving unit 116 is for driving the rotary shaft 113.

The end portion of the chute 111 may be downwardly inclined from the front surface of the accommodation portion 120 toward the rear surface thereof.

The opening and closing member 115 can obstruct (e.g., prevent) the discharge of ice cubes or the like in a closed state, and may shield the end portion (e.g., outlet) of the chute 111 for obstructing (e.g., blocking) air transaction between an exterior of the refrigerator and the ice maker. As such, supply of external air into the ice maker and/or leakage of internal cool air from the ice maker is reduced during the closed state of the opening and closing member.

A motor 116*a* for generating a driving force for driving the opening and closing member 115 may be positioned at one side of the opening and closing member 115, for example, at an upper region of the accommodation portion 120.

The driving unit 116 may be positioned between the motor 116*a* and is the opening and closing member 115.

The driving unit 116 may include a driving gear 116*c* driven by the motor 116*a* as shown in FIG. 4. The driving motor 116*a* is driven by electricity.

Since the motor 116*a* driven by the electricity is used to open and close the opening and closing member 115, a solenoid which generates an impact sound upon being driven is not needed. Thereby, a, noise such as the impact sound, can be reduced.

Further, since the opening and closing operation of the opening and closing member 115 is performed by the driving gear 116*c*, reliability of the opening and closing operation of the opening and closing member 115 can be improved.

In this implementation, the motor 116*a* may be configured to rotate in a forward or backward direction.

Further, the motor 116*a* may be a direct current (DC) motor and may be operated by a voltage of 12V. The DC motor can reduce an occurrence of electric shock as compared to a motor operated by common alternating current (AC) power of 120V (or 220V). In addition, the DC motor may have an advantage in association with the characteristics of a refrigerator and a dispenser operating under a humid environment.

The motor 116*a* may be positioned such that a direction of a rotary to shaft of the motor 116*a* is in accordance with a direction that the accommodation portion 120 is recessed such as in a back-and-forth direction. The driving gear 116*c* may be configured to be swung by the motor 116*a* in a direction of the opening and closing member 115 being rotated.

Thus, the direction of the rotary shaft of the motor 116*a* and a rotation surface of the driving gear 116*c* are positioned perpendicular to each other, and the rotary shaft of the motor 116*a* may be coupled to a worm gear. Here, the worm gear may be configured in plurality in terms of number. Alternatively, other types of gears may be coupled to the rotary shaft of the motor 116*a*.

A driving protrusion 116*d* may be protruded from a side surface of the driving gear 116*c* to be parallel to the rotary shaft 113 and positioned at the driving gear 116*c*. The rotary shaft 113 may be coupled to the opening and closing member 115. The driving protrusion 116*d* may contact with a guide protrusion 113*a* extending from the rotary shaft 113 in a radial direction. The driving protrusion 116*d* may press the guide protrusion 113*a* in cooperation with the motion of the driving gear 116*c* to transfer a driving force.

Further, the guide protrusion 113*a*, as shown in FIGS. 4 and 5, may be configured to be downwardly curved. This curved configuration may be decided by considering an angle $\alpha$ between the discharge side end portion of the chute 111 and a horizontal surface, and a maximum open angle of the opening and closing member 115.

In addition, in this implementation, a stopper for restricting the open level of the opening and closing member 115 may be needed. The stopper may be implemented as a movement restricting groove 116*e* in the motor 116*a*. For example, when the driving gear 116*c* moves in a direction of the opening to and closing member 115 being open, the movement restrict groove 116*e* is in contact with the driving protrusion 116*d* to restrict the movement of the driving protrusion 116*d*.

The movement restricting groove 116*e* may be positioned at a motor cover 116*b* which covers the motor 116*a* and the driving gear 116*c*. The open angle of the opening and closing member 115 can be maintained by the movement restricting groove 116*e*.

As shown in FIGS. 6 to 9, a refrigerator having a dispenser 200 has the same configuration compared to the previous implementation in that the refrigerator includes a chute 211 positioned at an upper portion of the accommodation portion 120 for connecting between the ice maker 15 and the accommodation portion 120, an opening and closing member 215 for opening and closing the chute 211, a rotary shaft 213 coupled to the opening and closing member 215 for rotating the opening and closing member 215, and a driving unit 216 for driving the rotary shaft 213. However, a configuration of the driving unit 216 and a position of the opening and closing member 215 may be different from the previous implementation.

The driving unit 216 may include a driving gear 216*c* swung by the motor 216*a* in a direction of the opening and closing member 215 being open or closed, and a connection link 220 having a rotation center portion 222, configured to receive a driving force of the driving gear 216*c* coupled to one end of the connection link 220, and configured to transfer the driving force to a guide protrusion 213*a* coupled to another end of the connection link 220.

The opening and closing operations of the opening and closing member 215 by the driving gear 216*c* can reliably be performed. Further, even to if an open position and a closed position of the opening and closing member 215 may be varied by the connection link 220 due to design requirements, such variation may be applied without any change in the position of the motor 216*a*. This implementation may reduce (e.g., minimize) the cost increase due to the design variation.

The connection link 220 may include the rotation center portion 222 rotatably installed in parallel to a movement surface of the driving gear 216*c*, a first arm portion 221 coupled to a driving protrusion 216*d*, which is protruded from a side surface of the driving gear 216*c* to be parallel to the rotary shaft 213 of the opening and closing member 215, and a second arm portion 223 coming in contact with the guide protrusion 213*a* to transfer a driving force. The driving protrusion 216*d* may contact a movement restriction groove 216*e* to define an opened position of the opening and closing member 215. The movement restriction groove 216*e* may be defined in a motor cover 216*b*.

Figure 10:
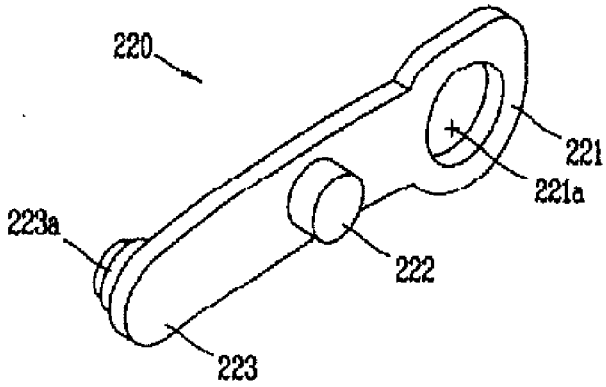
FIG. 10 is a side view showing an exemplary guide protrusion.

The first arm portion 221 may have a hole 221*a* in which the driving protrusion 216*d* is inserted as shown in FIG. 10.

Accordingly, without any change in the position of the motor 216*a*, the position of the rotation center portion 222, the position where the first arm portion 221 is coupled to the driving protrusion 216*d*, and the position where the second arm portion 223 comes in contact with the guide protrusion 213*a* may be adjustable in an open state and a closed state of the opening and closing member 215. This may reduce (e.g., minimize) fabricating cost due to the design variation.

The connection link 220 may be positioned at a rear surface of the accommodation portion 120 to rotate in a thickness direction of the door 13.

Further, in this implementation, the guide protrusion 213*a* may be slid to contact with a connection protrusion 223*a*, which is protruded from the second arm portion 223 to be parallel to the rotary shaft 213. The rotary shaft 213 is coupled to the opening and closing member 215 when the driving gear 216*c* is driven.

The guide protrusion 213*a* positioned at the driving gear 216*c* transfers the driving force to the connection protrusion 223*a*, and the opening and closing member 215 is operated in response to the transferred driving force.

Figure 9:
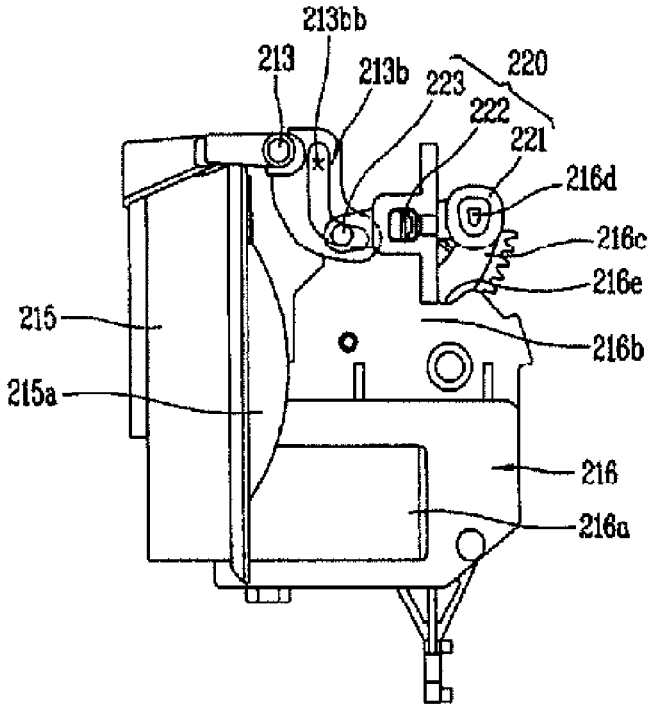
FIG. 9 is a perspective view of a connection link.

Referring to FIGS. 9 and 10, the connection protrusion 223*a*, which is protruded from the second arm portion 223 to be parallel to the rotary shaft 213 may be coupled to a guide slot 213*bb* positioned at the guide protrusion 213*b* in a lengthwise direction to receive a driving force.

It is advantageous that a trace of the guide protrusion 213*b* may stably be provided.

In addition, the opening and closing member 215 may be configured to have a size corresponding to a section of the chute 211 in a thickness direction. For example, the opening and closing member 215 may be configured to have a size greater than the outlet of the chute 211 so as to obstruct (close) the section of the outlet of the chute 211.

Here, the opening and closing member 215 may be positioned to be downwardly inclined by 40~42° from a horizontal surface in a closed state of the chute 211.

In general, a discharge side section of the chute 211 has an oval shape, and the opening and closing member 215 may be configured to correspond to the discharge side of the chute 211. The opening and closing member 215 may have a raised portion 215*a* configured to fit inside an opening of the chute 211. The raised portion 215*a* may provide a better seal of the chute 211 when the opening and closing member 215 is in a closed position.

In this implementation, if the discharge side section of the chute 211 is configured to be the same as the section of the chute 211 in its thickness direction, the discharge side section of the chute 211 may be configured to have a circular shape. For example, if the chute 211 may be configured such that a central line thereof can be inclined by 40~42° from a horizontal surface, a plane of the outlet of the chute 211 may be configured to be perpendicular to the central line of the chute 211. Accordingly, the section of the outlet of the chute 211 may have a circular shape. Further, the size of the opening and closing member 215 can be decreased. With such configuration, a less amount of materials can be required to make the opening and closing member 215. Also, since the opening and closing member becomes lighter, the capacity of the motor 116*a* can be decreased. In addition, since the radius of rotation of the opening and closing member 215 is shortened, the height h (see FIG. 2) of the shielding portion can be decreased. This provides the relative increase in the height H of the accommodation portion. Therefore, the container C having more space can be facilitated to be put in or out of the accommodation portion.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A refrigerator, comprising:

a main body having a cooling chamber;

a dispenser having an accommodation portion positioned at a front side of the refrigerator and configured to provide ice through the accommodation portion without opening a door of the refrigerator;

a chute having an outlet, coupled to the dispenser, and configured to transfer ice stored in an ice container to the dispenser;

an opening and closing member positioned at the outlet of the chute and configured to open or close the outlet of the chute;

a motor configured to generate a driving force to move the opening and closing member;

a guide protrusion defined at a shaft of the opening and closing member; and a driving unit configured to be driven by the motor and configured to apply force to the guide protrusion to open and close the opening and closing member, wherein the driving unit comprises:

a driving gear rotated by the motor in a direction of the opening and closing member being open or closed; and a connection link having a central portion rotatably fixed so as to receive a driving force of the driving gear at one end thereof and transfer the driving force to the guide protrusion at another end thereof, and wherein the connection link comprises:

a rotation center portion rotatably disposed to be parallel to a movement surface of the driving gear;

a first arm portion coupled to the driving protrusion, the driving protrusion extending from a side surface of the driving gear to be parallel to a rotary shaft of the opening and closing member; and a second arm portion coming in contact with the guide protrusion to transfer a driving force.

2. The refrigerator of claim 1, wherein the guide protrusion is slid to come in contact with a connection protrusion upon the driving gear being driven, the connection protrusion extending from the second arm portion to be parallel to the rotary shaft of the opening and closing member.

3. The refrigerator of claim 2, wherein the connection protrusion is coupled to a guide slot to receive a driving force, the guide slot being disposed at the guide protrusion in a lengthwise direction thereof.

4. The refrigerator of claim 1, wherein the opening and closing member is configured to be downwardly inclined about 40~42° from a horizontal surface when the chute is closed.

5. The refrigerator of claim 1, wherein a plane of the outlet of the chute is configured to be perpendicular to a central line of the chute.

6. The refrigerator of claim 1, wherein the opening and closing member is opened in response to detecting an insertion of a container to the dispenser.

7. The refrigerator of claim 1, wherein the dispenser further includes a shield portion configured to visually shield at least one component in the dispenser.

8. The refrigerator of claim 7, wherein at least one control button is positioned on the shield portion.

9. The refrigerator of claim 1, wherein the driving unit is configured to enable adjustment of a position of the opening and closing member without moving the driving motor.

10. The refrigerator of claim 1, wherein the driving motor is a direct current (DC) motor.

11. The refrigerator of claim 1, wherein the opening and closing member and the outlet of the chute have a circular shape.

* * * * *